United States Patent [19]

Gernert

[11] Patent Number: 4,917,177

[45] Date of Patent: Apr. 17, 1990

[54] COOLED ARTERY EXTENSION

[75] Inventor: Nelson J. Gernert, Elizabethtown, Pa.

[73] Assignee: Thermacore, Inc., Lancaster, Pa.

[21] Appl. No.: 410,541

[22] Filed: Sep. 21, 1989

[51] Int. Cl.[4] ..... F28D 15/02

[52] U.S. Cl. ..... 165/104.26; 165/104.27; 122/366

[58] Field of Search ..... 165/104.26, 104.27; 122/366

[56] References Cited

U.S. PATENT DOCUMENTS 3,661,202 5/1972 Moore ..... 165/104.26
3,677,336 7/1972 Moore ..... 165/104.26
4,520,865 6/1985 Bizzell ..... 165/104.26
4,627,487 12/1986 Basiulis ..... 165/104.26

*Primary Examiner*—Albert W. Davis, Jr.
*Attorney, Agent, or Firm*—Martin Fruitman

[57] ABSTRACT

An artery vapor trap. A heat pipe artery is constructed with an extension protruding from the evaporator end of the heat pipe beyond the active area of the evaporator. The vapor migrates into the artery extension because of gravity or liquid displacement, and cooling the extension condenses the vapor to liquid, thus preventing vapor lock in the working portion of the artery by removing vapor from within the active artery. The condensed liquid is then transported back to the evaporator by the capillary action of the artery extension itself or by wick located within the extension.

5 Claims, 2 Drawing Sheets

COOLED ARTERY EXTENSION

SUMMARY OF THE INVENTION

The invention described herein was made in the performance of work under NASA contract NAS8-37261 and is subject to the provisions of Section 305 of the National Aeronautics and Space Act of 1958, Public Law 85-568 (72 Stat. 435; 42 USC 2457).

This invention deals generally with heat transfer, and more specifically with liquid transport arteries within heat pipes.

The use of arteries for liquid transport within heat pipes is well established, but so also, unfortunately, is the failure of such arteries because vapor penetration into the arteries or undesirable heating can cause a vapor bubble to block the liquid transport function of an artery. This problem is particularly apparent in heat pipes in which the artery is located within the wick in the evaporator region. In such structures the wick and arteries near the evaporator are very likely to be subjected to heat, and unwanted vapor may penetrate into or be generated within the arteries along with the vapor which will properly move into the vapor space for transport to the condenser. The vapor within the arteries will then be swept to the end of the evaporator most remote from the condenser by the movement of the liquid in the arteries returning to the evaporator. This vapor can then accumulate at the end of the evaporator and prevent liquid access to that portion of the arteries, leading to heat pipe dry out and potential failure Although there have been numerous heat pipes designed to help prevent vapor within arteries, there is no certain method of preventing it, particularly when the arteries are themselves exposed to heat. Therefore, the present invention takes a different approach. Rather than attempting to prevent vapor within the arteries, or more accurately, along with the use of methods for preventing vapor in arteries, the present invention operates to trap, remove and condense that vapor.

This is accomplished by a simple structure added to the conventional arteries of a heat pipe. The arteries are extended at the evaporator end of the heat pipe by the addition of structures which connect to the arteries and extend out of the active region of the evaporator. These extensions operate as capillaries when they are approximately the same cross section as the arteries within the heat pipe wick, and they extend out of the evaporator from the end of the evaporator which is most remote from the condenser. The extensions function as storage volumes for vapor which is swept to the evaporator ends of the arteries, and since the extensions are not in the active region of the evaporator, that is, they are not in a region of the heat pipe to which heat is being supplied, the presence of vapor within them has no effect on the operation of the heat pipe. In a real sense the vapor from the arteries is removed from and stored outside the heat pipe.

An interesting aspect of the invention is that this stored vapor will be reused. All that is required is that the extensions be cooler than the evaporator and be of approximately the same size as the arteries within the wick structure. When such an extension is cooler, the vapor within it condenses, and since it is in close proximity to the evaporator and the extensions are capillary structures, the resulting liquid is transported to and is available for evaporation at the evaporator. This transport function can also be aided by the addition of capillary wick structure located within the artery extension, with the wick structure within the extension interconnecting with the other wick structure within the heat pipe. Moreover, cooling of the extensions is virtually automatic. Since by design the extensions are at a location other than the evaporator, which is the hottest part of the heat pipe, it follows that they will be cooler than the evaporator unless some effort were to be made to heat them. In the preferred embodiment of the invention, the extensions are tubes which need only be made a certain minimum length so that conduction, convection, or radiation of heat to the surrounding medium will assure that they condense the vapor within them. It is, of course, also possible to more actively cool the artery extensions, for instance, by attaching cooling fins to their outside surfaces The present invention thus furnishes a new heat pipe structure which assures that an artery within a heat pipe will operate reliably, without vapor blockage, regardless of any incidental penetration or generation of vapor into the artery.

DETAILED DESCRIPTION OF THE INVENTION

Figure 1:
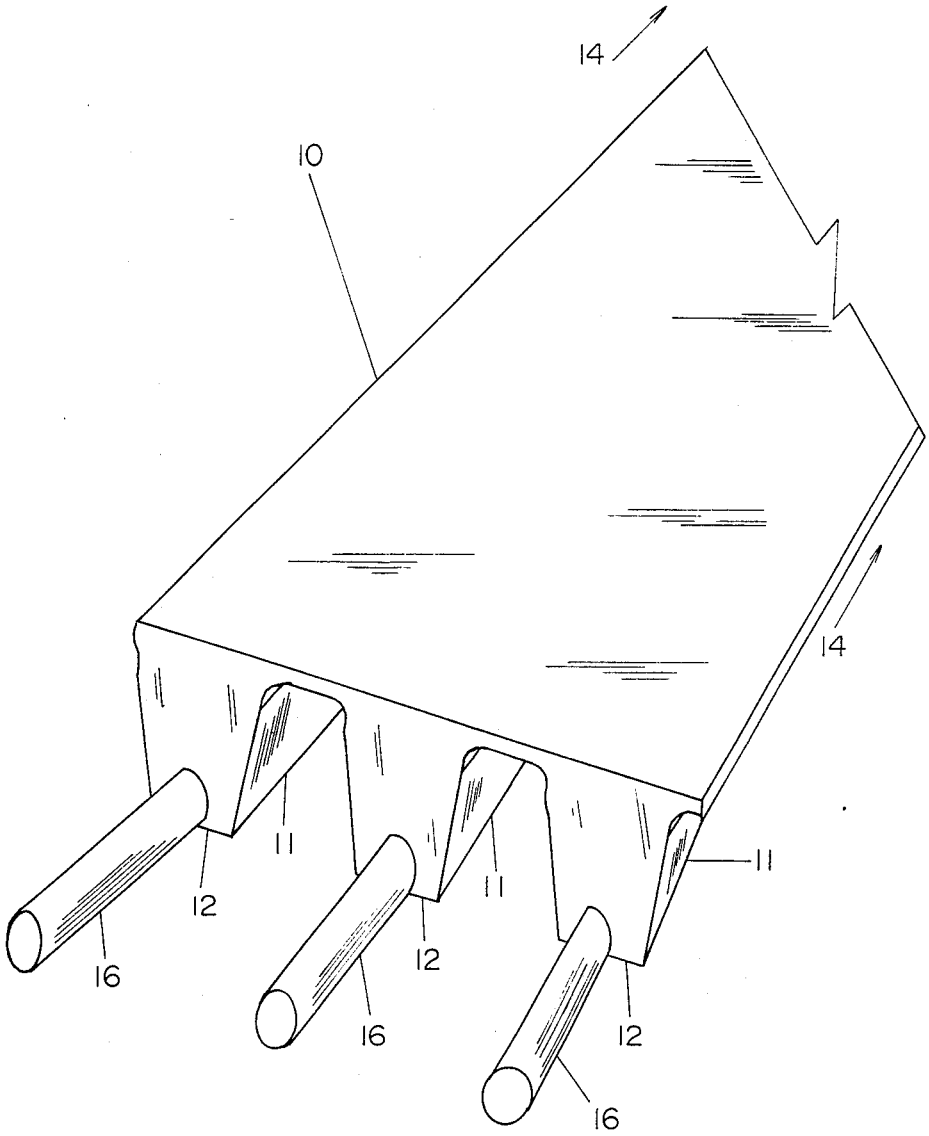
FIG. 1 is a perspective view of the preferred embodiment of the invention.

FIG. 1 is a perspective view of the preferred embodiment of the invention in which assembly 10 is constructed of three individual identical heat pipes 11. Only the evaporator ends 12 of heat pipes 11 are pictured. The condenser ends 14 of heat pipes 11 would be located off the drawing toward the upper right corner. An extension tube 16 is connected to each individual heat pipe 11 near the end of the heat pipe most remote from condenser end 14.

Figure 2:
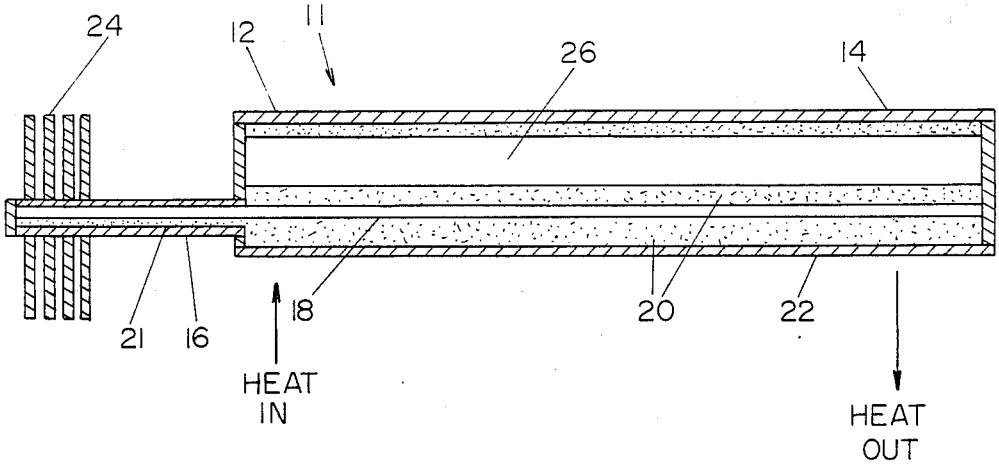
FIG. 2 is a cross section view of one heat pipe of the assembly of FIG. 1.

As shown in FIG. 2, each extension tube 16 is constructed to be an extension of conventional artery 18, which itself is located within wick structure 20. Except for the addition of extension tube 16, heat pipe 11 is conventionally constructed with sealed casing 22 evacuated of all noncondensible gases and loaded with a small quantity of vaporizable fluid. Vapor space 26 is the region in which vapor normally travels from evaporator region 12 to condenser region 14. Condenser region 14 is cooled causing the vapor to condense. Wick structure 20 and artery 18 are the means by which liquid is returned from condenser 14 to evaporator 12 where it is vaporized by the heat being applied to evaporator 12.

It is when vapor is present in artery 18 that heat pipe 11 is in danger of malfunctioning. Vapor can exist within artery 18 either because it penetrates into artery 18 from vapor space 26 or wick 20, or because liquid within artery 18 is vaporized within the artery due to heat applied directly to some portion of artery 18.

If extension tube 16 were not present, this undesirable vapor would be swept to the end of evaporator 12 most remote from condenser 14 and prevent liquid from being supplied to that part of the evaporator. This could cause overheating of a portion of the evaporator and could lead to destruction of the heat pipe.

However, with the addition of extension tube 16 in the present invention, this same vapor is swept into extension tube 16 to which no heat is being applied, so that evaporator 12 is left free to function normally. In the worst case the accumulated vapor will merely remain in extension tube 16 and cause no harm, but actually, under most circumstances, extension tube will be cooled sufficiently by the medium in contact with its outside surface so that the vapor within extension tube 16 will condense.

When the interior dimension of extension 16 is approximately the same as that of artery 18 it alone has sufficient capillary pumping action to move its condensed liquid back to evaporator 12, thus continuing the normal function of the heat pipe and preventing the volume of extension 16 from being completely filled with vapor so that the vapor would begin affecting evaporator 12. However, under some conditions, to better assure capillary return of liquid from extension 16 to evaporator 12, wick 21 may be added within extension 16. Wick 21 is connected to wick 20 so that it can supply liquid to evaporator 12 through wick 20.

To increase the cooling of extension 16 and better assure condensation of the vapor within it, cooling fins 24 may be added, but under most circumstances the length of extension 16 alone can be made sufficient to assure heat isolation from the evaporator and sufficient cooling to cause condensation of the vapor.

Other benefits also accrue from the structure of the present invention. One is that any noncondensible gases generated within the heat pipe can not accumulate at the evaporator end of the artery and, like unwanted vapor, block its operation. Like unwanted vapor, noncondensible gases are swept into the extension and remain there, causing no harm.

A further benefit is available from the present invention at start up of the heat pipe. In that situation, a cooled extension tube will condense existing vapor within the attached heat pipe artery and thereby furnish liquid to the evaporator to prime the heat pipe for starting.

It is to be understood that this form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For instance, extension shapes other than cylindrical cross section tubing could be used, and different means for cooling the extension may be used.

What is claimed as new and for which Letters Patent of the United States are desired to be secured is:

1. In a heat pipe which includes at least one liquid return artery which extends into the evaporator region of the heat pipe, the improvement comprising an extension structure attached to at least one artery at the end of the artery most remote from the condenser region of the heat pipe, with the extension structure extending out of the evaporator region of the heat pipe and into a region which is not subjected to heat.

2. The heat pipe of claim 1 wherein the extension structure is constructed so that it acts as a capillary structure to pump liquid from within the extension structure to the evaporator of the heat pipe.

3. The heat pipe of claim 1 further including a cooling means acting upon the extension structure to aid in condensing vapor within the extension structure.

4. The heat pipe of claim 1 wherein the heat pipe includes a first wick structure with at least one artery located within the first wick structure and an artery within the first wick tructure attached to the artery extension structure.

5. The heat pipe of claim 4 further including a second wick structure located within the extension structure with the second wick structure connected to the first wick structure so that liquid can move between the wick structures.

* * * * *